United States Patent [19]

deFilippis et al.

[11] 4,152,754

[45] May 1, 1979

[54] LASER AIMING DEVICE FOR WEAPONS

[76] Inventors: Gerald deFilippis, 10, Av. Vulliemin, Lausanne, Switzerland, 1005; Christiano Carpi, 6549 Pianezzo, Bellinzona, Switzerland

[21] Appl. No.: 769,533

[22] Filed: Feb. 17, 1977

[51] Int. Cl.[2] ..... F41G 1/34

[52] U.S. Cl. ..... 362/113; 42/1 A

[58] Field of Search ..... 42/1 A; 33/247, 248; 362/110, 111, 112, 113, 114, 425

[56] References Cited

U.S. PATENT DOCUMENTS

| | | | |
|---|---|---|---|
| 664,074 | 12/1900 | Benjamin | 362/114 |
| 829,726 | 8/1906 | McIntosh | 362/113 |
| 982,280 | 1/1911 | Lewis | 362/114 |
| 1,149,705 | 8/1915 | Ward | 42/1 A |
| 1,993,979 | 3/1935 | Reed | 42/1 A |
| 2,854,748 | 10/1958 | Williams | 33/248 |
| 3,513,581 | 5/1970 | Slater | 42/1 A |
| 3,867,764 | 2/1975 | Dunmire et al. | 42/1 A |
| 4,026,054 | 5/1977 | Snyder | 42/1 A |
| 4,048,489 | 9/1977 | Giannetti | 42/1 A |

FOREIGN PATENT DOCUMENTS

| | | | |
|---|---|---|---|
| 2617 of | 1910 | United Kingdom | 42/1 A |

*Primary Examiner*—Stephen C. Bentley

*Attorney, Agent, or Firm*—Ostrolenk, Faber, Gerb & Soffen

[57] ABSTRACT

A laser is attached to a weapon and its beam is aimed toward the target; the aiming point of the laser beam is adjustable with respect to the aiming point of the weapon; a lever for operating the laser is located to be operated as the trigger of the weapon is operated and to cause the laser to shine light at the target before the trigger has been operated enough to fire the weapon.

20 Claims, 21 Drawing Figures

FIG. 7.
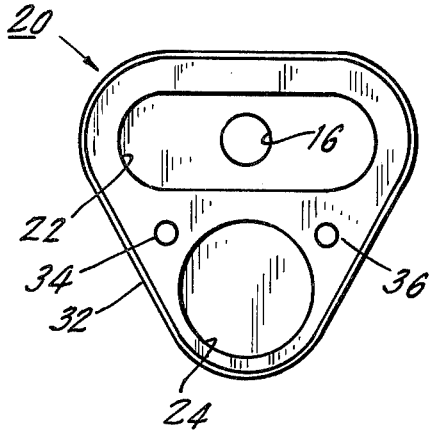
FIG. 6.
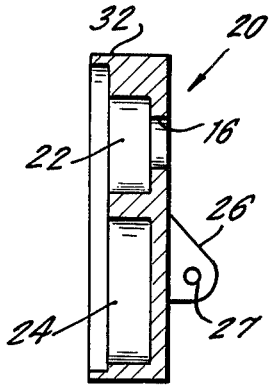
FIG. 5.
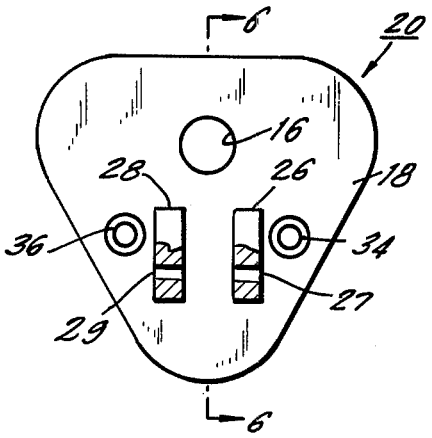
FIG. 8.
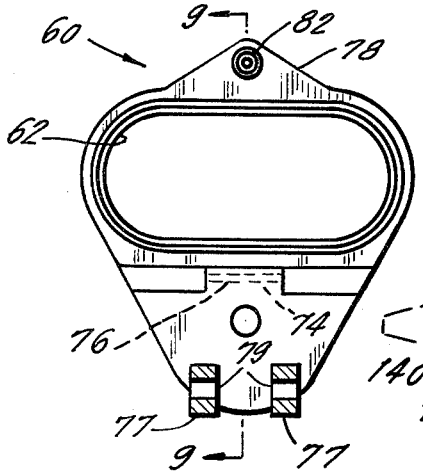
FIG. 9.
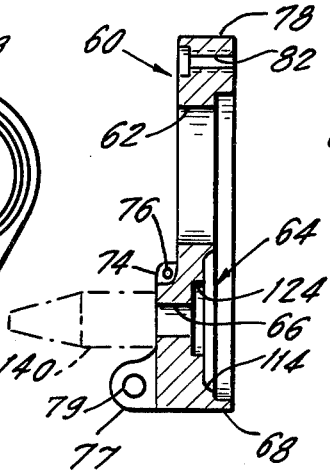
FIG. 10.
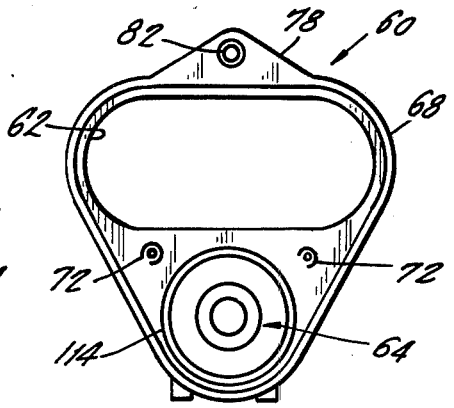
FIG. 14.
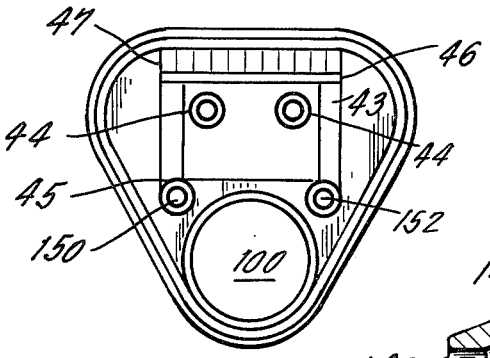
FIG. 13.
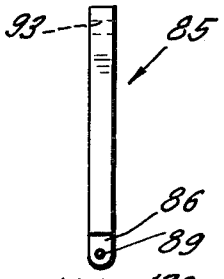
FIG. 12.
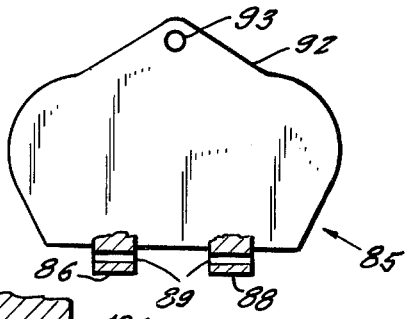
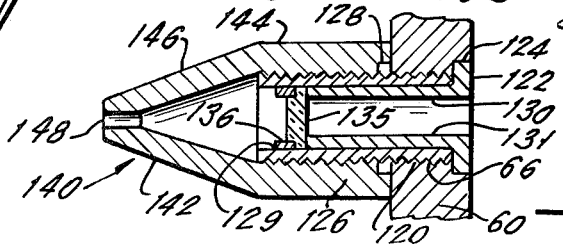
FIG. 11.

FIG. 16.
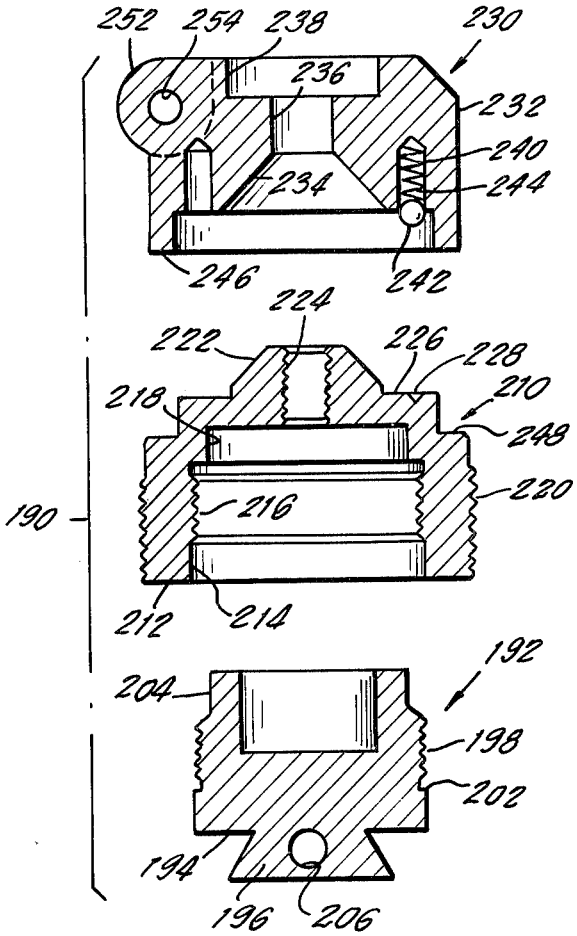
FIG. 18.
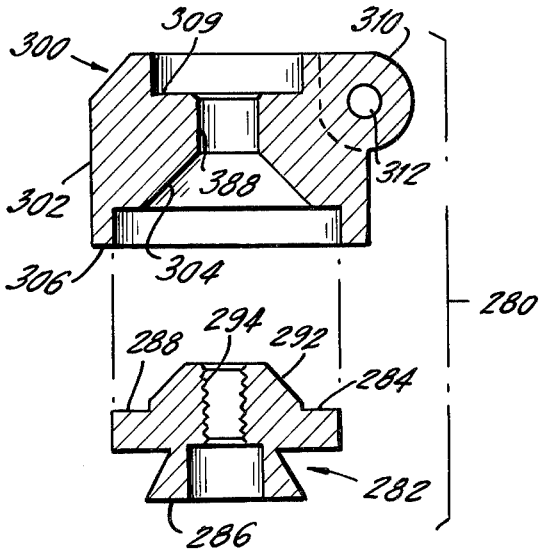
FIG. 19.
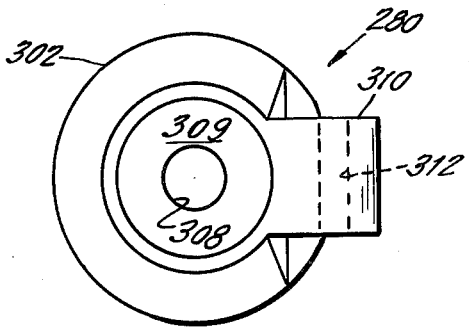
FIG. 17.
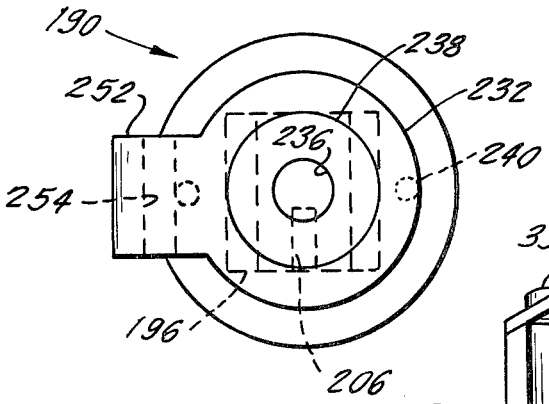
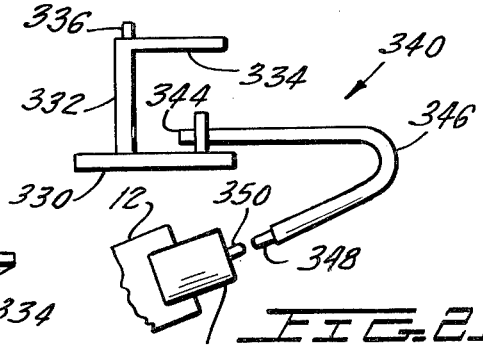
FIG. 21.
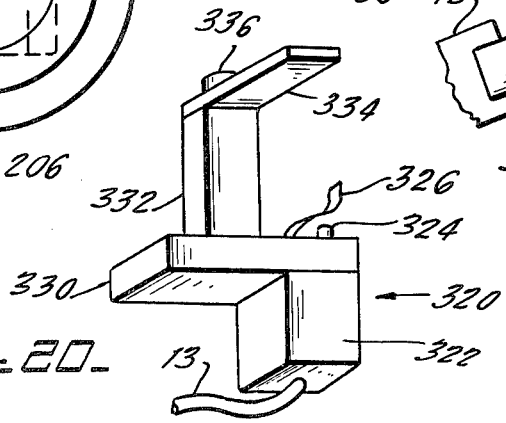
FIG. 20.

LASER AIMING DEVICE FOR WEAPONS

BACKGROUND OF THE INVENTION AND DESCRIPTION OF THE PRIOR ART

The present invention relates to an aiming device for any weapon that fires a projectile at a target which is in the line of sight from the weapon. In particular, the invention relates to a laser aiming device which shines a laser beam on the target and enables a marksman to preview the area of anticipated impact of the projectile.

Aiming a weapon is often difficult. The target sighting device, i.e. gunsight of the weapon must be placed at the marksman's eye, and especially with hand held weapons, such as rifles, or the like, this may not be a comfortable or steady position for holding or firing the weapon. Further, the usual procedures of sighting on a target and the designs of standard sighting devices greatly restrict the marksman's field of view of the target, and, on occasion, time must be spent to locate the target in the sighting device. Additionally, a marksman may have to close one eye to adequately sight on the target, greatly restricting his field of view and rendering him unable to know about events taking place in his immediate vicinity. Conventional aiming devices do not permit the marksman or operator of the weapon to preview precisely the impact area of the weapon. They only permit the marksman to visualize the general field of the target. Thus, aiming efficiency is relatively low. Aiming efficiency will only improve with the help of specialized equipment, such as radar, which requires additional experienced personnel for its operation. Further still, weapons often must be fired under poor visibility conditions, e.g. at night, at obscure targets and under unfavorable weather conditions. Additionally, great speed of aiming and ease of aiming are both hard to attain with conventional aiming devices.

Conventional weapon aiming devices are either optical and use front and rear sights, or they are infrared, or they are optical and mechanical or electromechanical as in larger guns, like tank guns, or they are electronic as used with non-manually controlled weapons such as antiaircraft weapons, particularly those controlled by radar. Each of the various conventional techniques of aiming a weapon has at least some of the above described drawbacks.

One technique for overcoming the foregoing difficulties encountered in aiming a weapon is to project a laser beam or other appropriate light beam onto the target. When the target is illuminated by the laser or light beam, the trigger of the weapon is operated. If the laser or other light beam is properly zeroed in on the aiming point of the weapon, the projectile fired by the weapon will strike where the light is shining.

One previously tried application of this technique consists of nonmovably affixing a laser tube to the barrel of a rifle. The laser beam is initially zeroed on the aiming point of the rifle. Once the laser beam has been aimed, its aiming point cannot be readjusted. The operating mechanism for activating the laser is located away from the trigger of the weapon. After the marksman has shown the laser beam to aim the weapon, the marksman then moves his hand to and operates the trigger of the weapon. The foregoing device has proven unacceptable because the unadjustably aimed laser beam has not always shown precisely on the target. This is due in part to the shocks to which a weapon is exposed in use which may shift the aiming point of the laser beam.

Further, when the marksman moves his hand from the laser operating mechanism to the weapon trigger, he sometimes throws the aiming point of the weapon off the target area.

SUMMARY OF THE INVENTION

The present invention is an improved laser aiming device which seeks to overcome the above described drawbacks of prior art aiming devices and of the known form of laser aiming device.

The invention offers a relatively small weapon aiming device that can be easily carried on any hand held weapon and which requires virtually no training or experience to operate. The device permits a marksman to visualize the target and the precise impact zone of the projectile using both eyes, which is the way the marksman is used to seeing objects.

The laser aiming device according to the invention comprises a mounting support which is fixedly attached to the weapon. The rest of the laser aiming device is attached to its mounting support. The aiming device includes zeroing means connected between the mounting support and the rest of the device and which enable the aiming point of the laser beam to be readjusted up and down or sideways after the aiming device is mounted on a weapon. Further, should subsequent rezeroing of the aiming device become necessary, due, for example, to slight shifting of the aiming device with respect to the weapon, the zeroing means between the laser and its mount permit the aiming device to be rezeroed.

The operating lever for the laser is placed so that as the trigger of the weapon is first operated, the laser operating lever is simultaneously moved and the laser beam shines. The weapon is then aimed so that the target is illuminated. Then the marksman continues moving the trigger of the weapon to fire the projectile. Thus, the same trigger stroke that eventually fires the weapon initially aims it.

In the laser aiming device of the present invention, when the laser is operated, a laser beam is projected toward the target. The laser beam is normally invisible. But, when it strikes the target, it forms a visible dot on the target. When the marksman has moved the weapon so that the visible dot is over the target, he completes operating the trigger of the weapon. If the laser beam has been properly zeroed in with the weapon, the projectile fired from the weapon should impact on the illuminated target. Another benefit of a laser aiming device is that once the device has been zeroed at one range, it is automatically zeroed for all ranges.

One major problem with a laser aiming device is to ensure that the laser light source remains level within the housing of the aiming device so that the laser beam will reliably exit through a very small outlet opening at the front end of the housing. If the laser becomes even slightly misaligned, the radiating light will be lost inside the housing and will not exit through the outlet. A further problem is to ensure that the laser and the entire aiming device are not misaligned due to weapon recoil, shocks in handling or other ambient conditions. In accordance with the invention, the laser is securely anchored in the aiming device and the aiming device securely holds the laser to prevent its undesired shifting.

A laser aiming device according to the invention has been effectively tested at ranges up to 4 km., and a weapon including this device has been accurately fired at a range of approximately 1,000 yards.

Although a projectile fired by a weapon usually has a generally parabolic, ballistic trajectory, nonetheless the projectile should always hit the target within the area illuminated by the laser beam. A laser beam is a luminous coherent monochromatic, collimated light ray. Such a ray has a diffraction factor of approximately 1.6 milliradians. This degree of diffraction assures the aiming device of the invention will always be accurate. For example, under normal atmospheric conditions, at a distance of 100 m. between the laser and the target, the diameter of the illuminated dot on a flat target that is perpendicular to the laser beam is approximately 10 cm. At this 100 m. distance, the projectile, e.g. a bullet from a rifle, will strike the target precisely at the middle of the circle of illumination. At a 300 m. distance, the circle of illumination will have a diameter of approximately 30 cm. At this same distance, the projectile will strike the target slightly below the middle of, but definitely within the circle of illumination. At 50 m. distance, the circle of illumination will have a diameter of 5 cm., and the projectile will strike within the circle of illumination, but slightly above its middle.

Accordingly, it is the primary object of the present invention to provide an aiming device for a weapon.

It is another object of the present invention to provide such an aiming device which has the benefits described above and which avoids the drawbacks of the prior art described above.

It is a further object of the invention to provide such an aiming device which uses a laser.

It is another object of the invention to provide a laser aiming device which can be zeroed and rezeroed on the aiming point of the weapon.

It is a further object of the invention to provide such an aiming device which does not require the marksman to perform a special operation just before firing the weapon to activate the aiming device.

It is yet another object of the invention to provide such an aiming device which is operated as the trigger of the weapon is operated.

The foregoing description of the invention and the foregoing and other objects of the invention will be further explained in the following detailed description of a preferred embodiment of the invention, taken in conjunction with the accompanying drawings.

BRIEF DESCRIPTION OF THE DRAWINGS

FIG. 5 is an outside elevational view of the rear plate of the housing of the aiming device;

FIG. 6 is a cross-sectional side elevational view of the rear plate along the line 6—6 of FIG. 5;

FIG. 7 is an inside elevational view of the rear plate;

FIG. 8 is an outside elevational view of the front plate of the housing of the aiming device;

FIG. 9 is a cross-sectional side elevational view of the front plate along the line 9—9 of FIG. 8;

FIG. 10 is an inside elevational view of the front plate;

FIG. 11 is a cross-sectional side view of an outlet nozzle from the aiming device;

FIG. 12 is an end elevational view of a door over the front end of the housing of the aiming device;

FIG. 13 is a side view of the door of FIG. 12;

FIG. 14 is an elevational view just inside the rear plate, showing some components of the aiming device and along the line 14—14 of FIG. 1;

FIG. 16 is an exploded, cross-sectional, side elevational view of the rear mount for the aiming device on its mounting bar;

FIG. 17 is a top view of the rear mount of FIG. 16;

FIG. 18 is an exploded, cross-sectional, side elevational view of the front mount for the aiming device on its mounting bar;

FIG. 19 is a top view of the front mount of FIG. 18.

FIG. 20 is a perspective view of one weapon trigger actuated operator of a laser aiming device; and FIG. 21 is a diagrammatic view of a second embodiment of such an operator.

DESCRIPTION OF A PREFERRED EMBODIMENT

Figure 1:
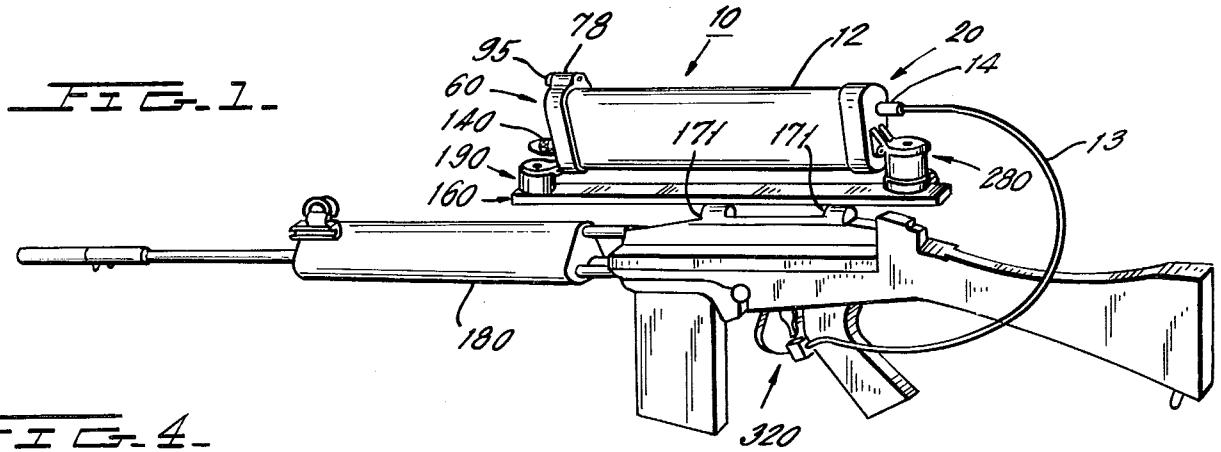
FIG. 1 is a perspective view of a rifle fitted with an aiming device according to the present invention.

One embodiment of a laser aiming device according to the invention is now described.

The aiming device 10 is activated by an operator 320 described below, which acts through a cable 13, described below. The cable 13 leads to the housing 12 of the laser aiming device 10, and the cable is received in the plug 14 at the rear end of the casing 12.

Turning to the schematic circuit of FIG. 4, the plug 14 is connected by a cable 15 into the below described battery 50. The battery 50 is connected by a cable 17 into the transformer 40. The transformer is electrically connected by appropriate cables 19 to the laser lamp or light source 100.

The plug 14 passes through the opening 16 in the rear wall 18 of the rear end plate 20 shown in FIGS. 5–7. The opening 16 and the plug 14 passing therethrough are sealed so that water, moisture, dirt and other contaminants cannot enter the housing 10.

The casing 12 has a uniform, generally triangular, vertical cross-sectional shape, with rounded apices. The casing 12 is normally oriented with one of its apices aimed downwardly and with the laser tube 100 being positioned near the bottom of the casing. The casing is an integral tube, and its material is rigid and strong so as not to be damaged through normal use.

The rigid rear plate 20 of FIGS. 5–7 includes the upper cable housing 22 for storing cable connections between the laser tube 100 and the transformer 40 and between the plug 14 and the battery 50. The rear plate 20 also has a lower circular chamber 24 for receiving the rear support block 102 for the laser tube 100.

On the rear, outside of the rear plate 20, there are a pair of mounting flanges 26, 28 which receive the mounting flange 252 of the rear mount 190 for the casing 12. Each flange 26, 28 has a respective aligned opening 29 therethrough for receiving a fastening pin, screw, or the like that holds the end plate 20 on the below described mount 190.

The rear plate 20 has a forwardly projecting peripheral lip 32, which seals around the exterior of the rear end of the casing 12 to seal out moisture and contaminants.

The rear plate 20 also has the openings 34, 36, therethrough, which receive the end plate fastening bolts 150, 152.

The transformer 40 is supported forward of the rear plate 20 by support means described below. The transformer is electrically connected by cables 17 with the conventional electric battery 50 that is located forward of the transformer 40 in the casing 12. For example, the battery is an 12.2 ± 2.4 VDC, 2.8 ampere battery. The transformer transforms the voltage to 1500 ± 50 volts.

Figure 3:
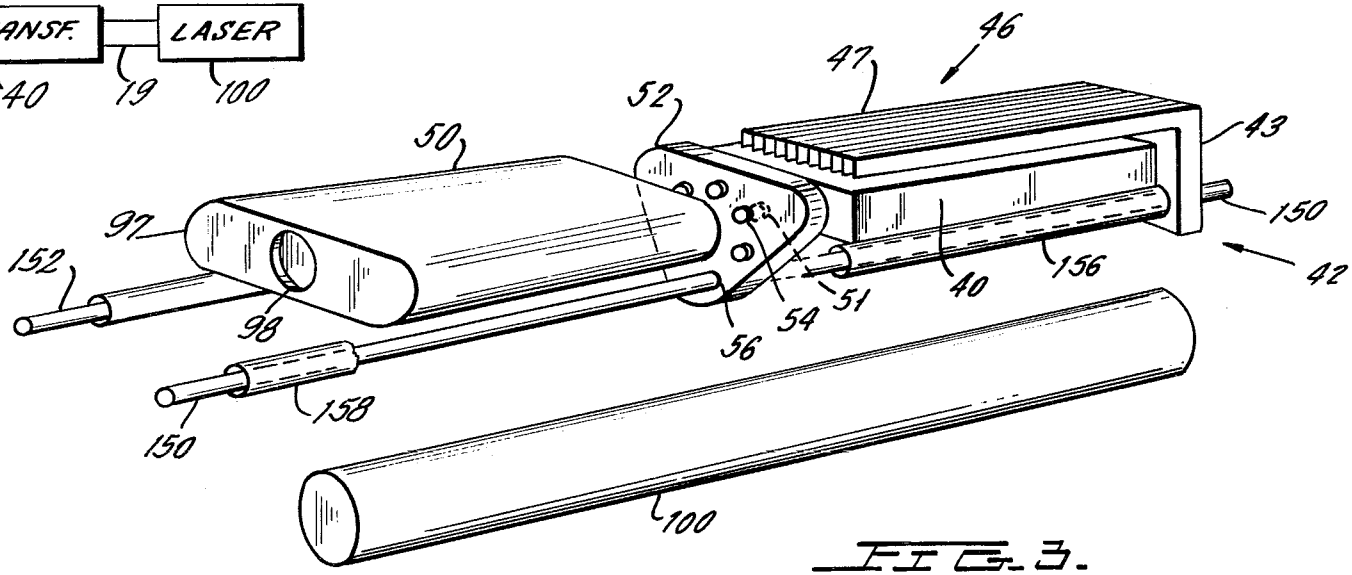
FIG. 3 is an exploded perspective view of some of the components of the aiming device, showing their relationship.
Figures 2, 15:
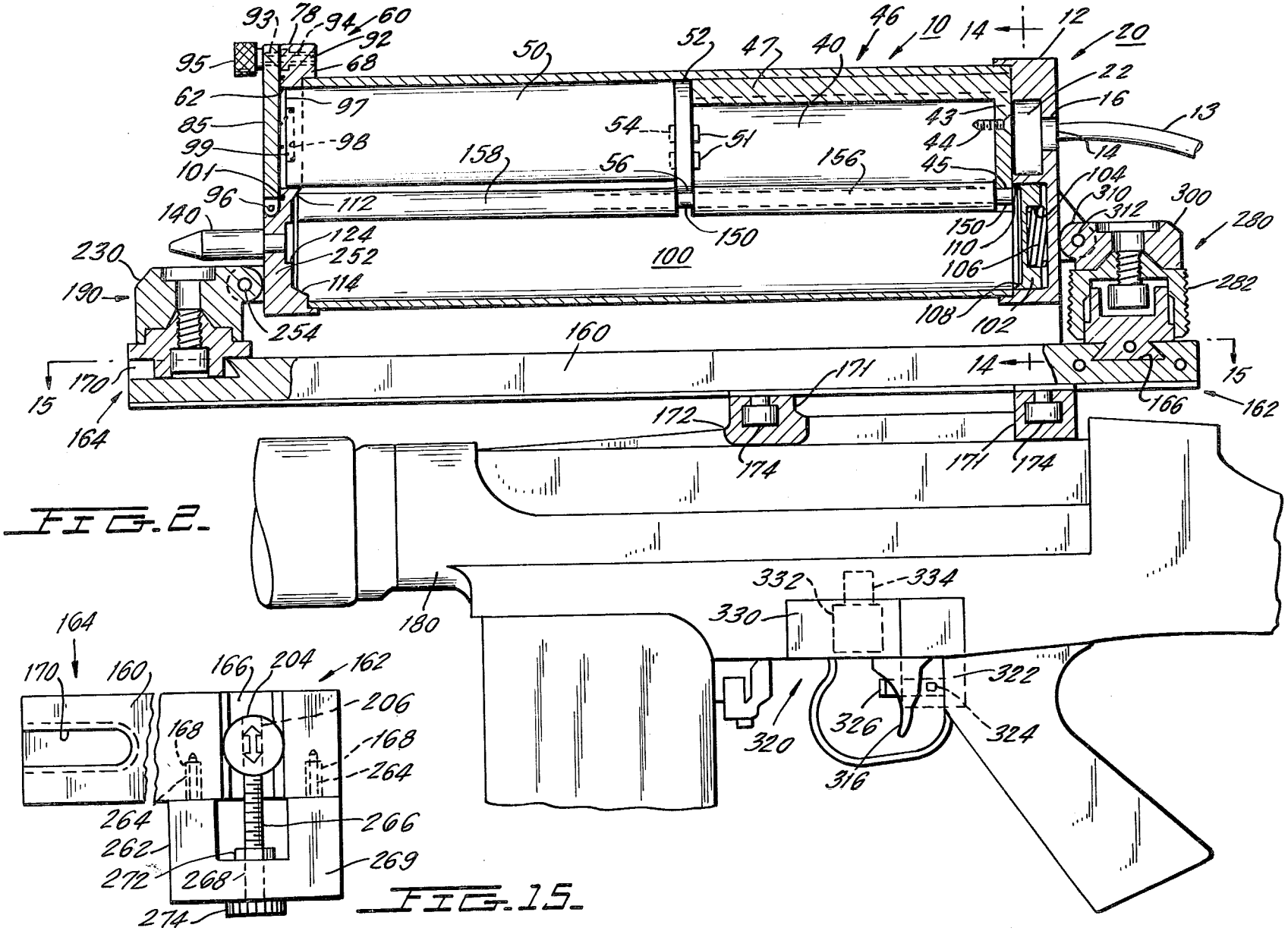
FIG. 2 is a cross-sectional elevational view of an aiming device according to the invention.
FIG. 15 is a top view of the mounting bar of FIG. 14 and showing transverse moving means for the aiming device.

A generally L-shaped transformer support and heat radiator assembly 42, shown in FIGS. 2, 3 and 14, includes the rear supporting plate 43 located behind the transformer 40 and against which the transformer 40 abuts. Screws 44 join the transformer 40 mechanically to the rear supporting plate 43. The plate 43 is provided with the support bolt receiving holes 45 therethrough for receiving the bolts 150, 152. These bolts hold the entire assembly 42 in place. The top leg 46 of the assembly 42 comprises a radiator 47 comprised of a plurality of parallel upstanding heat radiating vanes. During operation, the transformer 40 generates considerable heat which is conducted to vanes 47 and is radiated into the interior of the casing 12 by the vanes.

A partition 52 is positioned between the transformer 40 and the battery 50. The rear (right-hand) surface of the partition 52 is provided with contacts 51 which engage cooperating electric contacts on the transformer. The front surface of the partition 52, facing the battery 50, carries a plurality of contacts 54 for engaging the cooperating battery contacts. The contacts 51, 54 on the partition 52 enable the battery and the transformer to be electrically connected and cause these elements to be mechanically aligned in the casing. The partition 52 also is affixed in position on the bolts 150, 152. Holes 56 pass through the partition 52 for receiving these bolts.

At the forward side of the battery, the casing 12 is sealed closed by the rigid front plate 60, shown in FIGS. 9–11. The front plate 60 has an upper, large width, round end opening 62 passing through it, through which the battery 50 may be inserted into and removed from the casing 12. The lower, rearwardly facing, inward side of the front end plate 60 is provided with a stepped, tapering opening 64, detailed further below, for positioning the front end of the laser tube 100 and the laser beam outlet nozzle 140. A narrower width light passage opening 66 is provided in the plate 60 through which the laser light enters the outlet nozzle. On its rearwardly or inwardly facing side, the plate 60 has an annular peripheral, rearwardly extending rim 68, which passes around the casing 12 and seals the front plate 60 against the casing to exclude moisture and contaminants.

At its rearwardly facing side shown in FIG. 10, the plate 60 has tapped, threaded, bolt receiving openings 72 for receiving the free, forward ends of the bolts 150, 152. Tightening of these bolts draws both the front plate 60 and the rear plate 20 against the casing 12, thereby securely sealing the casing between the end plates.

The front plate 60 has the forwardly projecting mounting tabs 77 thereon with aligned holes 79 therethrough for receiving a mounting pin that cooperates with the mounting flange 310 of the below described front mount 280, for mounting the front end of aiming device 10 to the support bar 160, as described below.

The front plate 60 is also provided with a battery opening door hinge mount 74 through which a hinge pin receiving opening 76 passes. The flange 78 projecting above the top of the plate 60 includes the threaded opening 82 therein for receiving the door locking bolt 96.

Referring to FIGS. 12 and 13, the door 85 is of a size adequate to cover all of the battery opening 62 on the open, forward side of the front plate 60 and it has a peripheral shape, especially where it meets the periphery of the plate 60, such that it does not project beyond the periphery of the plate 60. The door includes the downwardly projecting hinge mount tabs 86, 88, having the hinge pin receiving openings 89. The door also has an upwardly extending flange 92, which is shaped to the shape of the flange 78 of the forward plate 60. The flange 92 includes an opening 93 therethrough for receiving the shaft of the door securing bolt 94, and the opening 93 is smaller than the head 95 of that bolt, so that the bolt 94 may be passed through the opening 93 and tightened into the threaded receiving hole 82 in the front end plate flange 78. The knurls on the periphery of the bolt head 95 permit it to be manually removed in the field for battery replacement. The hinge pin 96 passes through the aligned openings 76, 89 for hinging the door 85 to be opened and shut for insertion and removal of the battery 50.

The bottom (left) side 97 of the battery, which does not have electric contacts on it, has a depression 98 for receiving the compression spring 99 that urges the battery securely against the partition 52 when the door 85 is closed. The spring is attached on the bottom of the battery, whereby when the door 85 is open, the spring will not fall away. The battery 50 holds the partition 52 securely against the contacts of the transformer 40, effecting electric contact along the entire series of elements. Should the aiming device 10 be jolted or shocked during normal use of the weapon to which the aiming device is attached, the spring 99 ensures continued electric contact and proper placement of the elements affected by the bias of the spring 99.

An O-ring 101 seals the battery enclosure in the casing 12 when the door 85 is closed.

The laser tube 100 is located in the casing 12 beneath both the transformer 40 and the battery 50 and is oriented parallel to them. The laser 100 is a standard helium-neon laser operating at 2 milliwatt. The laser is oriented such that its light is directed to the front of the casing 12. By cables 19, the transformer is connected to and operates the laser (see FIG. 4).

The laser is mechanically held within the casing 12 between the rear plate 20 and the front plate 60 which enclose the casing. Positioned inside the circular chamber 24 of the rear plate 20 and correspondingly shaped around its periphery to the interior periphery of the chamber 24 is the laser tube positioning support block 102 which is of a length enabling it to be axially shifted through the chamber 24. The rear side of the support block 102 has a receiving opening 104 for receiving the normally charged compression spring 106. The spring 106 extends between the rear side of the support block 102 and the front side of the rear plate 20 inside the chamber 24. The front side of the support block 102 is contoured with an annular taper and/or chamfer having at least one tapered step 108 for receiving a corresponding annular chamfer or taper on the rear end of the laser tube 100. The laser tube 100 is correspondingly annularly tapered or chamfered on its rear edge at 110 for cooperatingly mating with the chamfered surface 108. This mating arrangement, when the tapering surfaces 108, 110 are in engagement, and with the rear support block 102 secured against sideward motion in the chamber 24, anchors the rear end of the laser tube 100 against moving laterally across the casing 12 and it also biases the laser tube normally forwardly toward the front plate 60. Further, in the event the aiming device 10 is jolted in use, shifting of the laser is absorbed by the spring 106.

The front end of the laser tube 100 is also provided with an annular chamfered surface 112, by which the laser tube is supported. Referring to FIGS. 9 and 10, the opening 64 in the rearwardly facing side of the front plate 60 is provided with a cooperatingly chamfered annular surface 114, against which the laser tube surface 112 is securely seated. The above described securement of the laser tube ensures that the light exiting from the laser tube is properly aimed toward the target.

As noted above, the narrowed width light outlet 66 through the front plate 60 passes the light exiting from the laser tube. Located inside the opening 66 are two concentric tubes. The external tube 120 has an interior flange 122 that seats in the undercut opening 124 at the inside of the front end plate 60. The exterior 126 of the tube 120 extending forwardly of the plate 60 is screw threaded.

A matingly threaded nut 128 is tightened over the threaded exterior surface 126 against the plate 60 and cooperates with the flange 122 to hold the tube 120 securely in place. Projecting inwardly from the inside of the tube 120 near its forward end is an annular rib 129 for holding the sealing lens 135 in place.

The interior of the tube 120 is screw threaded at 131 for receiving the internal tube 130. The internal tube 130 has an external diameter corresponding to the internal diameter of the external tube 120, and the internal tube 130 is correspondingly screw threaded to the screw threads 131 on the interior of the tube 120. The interior tube 130 is screwed into the exterior tube 120 from the right as viewed in FIG. 9. The tube 130 is screwed tightly enough to hold the sealing lens 135 between the forward annular edge of the internal tube 130 and the rearwardly facing edge of the annular rib 129.

The sealing lens 135 between the tube 130 and the rib 129 is a flat, plain, transparent plate comprised of a quite hard material, e.g. an artificial ruby comprised of corindon, or the like. The lens is securely held in place and seals the passageway leading toward the laser tube, whereby the laser is sealed at its outlet side against moisture, contaminants or the like. An O-ring 136 is interposed between the rib 129 and the lens 135 for ensuring that seal.

A hollow nozzle 140 extends from the tube 120 and defines the outlet for light from the laser. The nozzle 140 includes the tube 142 which is screw threaded at the interior of its rear portion 144 and is sized to mate with the screw thread 126 on the exterior of the tube 120, such that the tube 142 may be tightened up against and supported against the front side of the plate 60. At its interior 146, the tube 142 gradually tapers narrower conically, moving forwardly of the lens 135, until it is narrowed to a small outlet hole 148. At the outlet from the laser tube 100, the laser beam has a width of 0.5 mm. At the outlet 148, the opening is a relatively larger 1 mm. The length and narrowing of the nozzle 140 ensures unidirectional radiation without stray radiation. The interior surface of the tapered opening 146 is painted or otherwise darkened black so as to be nonreflective. The purpose of the nozzle 140 and particularly of its darkened interior 146, is to prevent stray radiation from projecting off to the sides of the aiming device, which could blind or interfere with the vision of the marksman and of those operating at his side.

Referring to FIGS. 2, 3, 5, 7 and 10, a pair of elongated bolts 150, 152 extend across the entire length of the casing 12, with the bolt 150 extending through the hole 36 in the plate 20, through the hole 45 in the wall 43, through the hole 56 in the partition 52 and into the aligned hole 72 in the front end plate 60. The hole 72 is screw threaded to receive the bolt 150, such that tightening of the bolt 150 draws its head against the outside, rearwardly facing side of the plate 20 and pulls the plate 60 toward the plate 20. Similarly, the bolt 152 passes through the hole 34 in the plate 20, through the aligned holes in the intermediate elements and into the other hole 72 in the plate 60. The tightening of the bolts 150, 152 securely holds the end plates together and holds the entire casing 12 and the elements therein together.

There are positioned over the bolts 150, 152 identical sets of freely movable spacer sleeves. Over bolt 150, spacer sleeve 156 is interposed between the transformer support wall 43 and the partition 52 and spacer sleeve 158 is interposed between the partition 52 and the front plate 60. The lengths of the sleeves 156, 158 are selected to ensure that the elements resting against them, and particularly the partition 52, are properly placed when the bolts 150, 152 are tightened and to ensure that all of the elements of the aiming device, and particularly the transformer 40 and battery 50 have uniform, predictable pressure applied to them.

For mounting the above described aiming device on a weapon, such as the rifle 180, a mounting assembly is provided. It includes the mounting bar 160 of FIGS. 1 and 15, the front mount of FIGS. 18 and 19, and the rear mount of FIGS. 16 and 17.

Referring to FIGS. 1, 2 and 15, the weapon mount for the aiming device includes the elongated mounting bar 160 which is oriented along the length of the weapon. The bar has the rear mounting formation 162 away from the muzzle of the weapon and the forward mounting formation 164 closer to the muzzle of the weapon. The rear formation 162 comprises a dovetail shaped groove 166, which extends laterally across the bar 160. By mechanisms to be described below, the dovetail groove 166 permits adjustment of the aiming point of the laser 100 sideways with respect to the weapon on which the mounting bar 160 is secured. The rear formation 162 further comprises the threaded screw receiving holes 168, by which the rear mount 190 of the aiming device is attached to the bar 160.

At the front end of the bar 160, the formation 164 comprises the elongated, dovetail shaped groove 170, whose direction of elongation permits the front mount 280 to be inserted in the groove 170 from the front end of the bar 160. Once the front mount 280 is inserted into the groove 170, the entire aiming device 10, and including the rear mount 190, is moved rearwardly with respect to the bar 160 sufficiently to align the rear mount 190 with the groove 166 in order that the rear mount 190 may be received in that groove. Once the rear mount 190 has been received in the groove 166, the front mount 280 is sufficiently back from the open front end of the front groove 170 as to preclude removal of the front mount from the groove.

The bar 160 is mounted on the standard gunsight receiving mount of a weapon 180, such as a rifle. The underside of the bar 160 is fitted with standard gunsight mounting elements 171. These mate with the gunsight mount 172 on the weapon. A screw 174, or the like attachment element, extends between the gunsight mounting elements 171 beneath bar 160 and the mount 172 at the top of the weapon for fastening the bar 160 securely to the weapon, in the same manner as any sight may be fastened thereto. The gunsight mounting elements on bar 160 will be different in design and arrangement, depending upon the gunsight mount atop that type of weapon. For mounting the aiming device of the invention on different weapons, the only change that has to be made is in the mounting arrangement beneath the bar 160.

The rear mount 190 for the aiming device 10 is shown in FIGS. 16 and 17. The mount 190 has a bottom section 192, which is comprised of the tubular body 194 with the dovetail shaped male attachment unit 196 depending beneath it. The male attachment unit 196 is cooperatingly shaped to be received in the dovetail shaped groove 166 near the rear end of the bar 160. Partway along its axial length, the body 194 is screw threaded at 198 on its exterior for effecting raising and lowering of the aiming point of the laser beam by vertically expanding and retracting the rear mount, as described further below. Beneath the screw threaded section 198 is the abutment 202 which limits the extent to which the rear mount 190 may descend. The narrowed width upper spigot 204 of the mount 190 helps guide the relative motion of the elements of the rear mount 190.

The screw threaded opening 206 passes at least part way through and along the length of the dovetail element 196 for receiving an aiming device horizontal position adjustment shaft 266.

The intermediate section 210 of the mount 190 is the only part thereof that is rotatable. It includes the tubular body 212 having a bottom opening 214 therein for receiving the portions 198, 204 of the bottom section 192 of the mount 190. The opening 214 includes the internally screw threaded section 216 which is cooperatingly, matingly threaded to the threaded section 198, such that with the threaded sections 198, 216 in engagement and as a result of rotation of the intermediate section body 212 with respect to the bottom section body 194, the intermediate section 210 rises and descends with respect to the body 194 vertically expanding and retracting the rear mount. The section 218 of the opening 214 receives the spigot 204 of the bottom section 192 of the mount and this guides the vertical motion of the mount. The exterior of the body 212 is knurled at 220 for being manually grasped and rotated by a person zeroing in the aiming device, so as to rotate the body 212 with respect to the body 192 and thereby raise or lower the aiming point of the laser beam with respect to the aiming point of the weapon.

The upper portion of the intermediate section 210 has a conical taper 222 to be received in the cooperating opening 234 beneath the upper section of the mount 190. A threaded screw hole 224 extends to the intermediate section 210 for receiving a fastening bolt that holds the top section to the intermediate section. Arrayed around the annular shelf 226 of the intermediate section 210 are a plurality of detent depressions 228 which cooperate with a detent means 242, 244 on the top section of the mount 190, whereby the intermediate section 210 may be rotated to a series of discrete positions, with the arrival at each position being signaled by a click caused by the detent ball 242 snapping into one of the receiving depressions 228.

The top section 230 of the rear mount 190 comprises the body 232 which has a conically tapered bottom opening 234 for receiving the cooperating conical taper 222 of the intermediate section 210 of the mount 190.

A bolt receiving hole 236, with a widened portion 238 for the head of a bolt (not shown) passes vertically through the body 232, and a bolt passed into the hole 236 is secured in the threaded hole 224, thereby to hold the top and intermediate sections of the mount 190 together loosely enough so as to permit the intermediate section 210 to be rotated with respect to the top section 230 and so that as the casing 12 is elevated through rotation of the intermediate section 210, the slight tilting of the casing 12 that is caused by one end thereof rising or descending while the other end does not correspondingly change its height, is absorbed by the connection between the top section 230 and the intermediate section 210. This result is also caused by the relative shaping of the cooperating elements of the adjacent mount sections.

The ball 242 is placed in one or more of the bores 240 in the body 232. Ball 242 is spring biased out of bore 240 by the compression spring 244 and into the depressions 228 so as to provide the above described detent arrangement. Further support and positioning of the upper section 230 with respect to the intermediate section 210 is obtained by the peripheral step 246 beneath the top section 230 abutting and resting on the upwardly facing step 248 of the intermediate section 210.

At the left side in FIG. 16 of the top section 230 is the mounting flange 252 having the opening 254 passing therethrough. The flange 252 is placed between the mounting flanges 26, 28 of the rear plate 20 of casing 12 and a fastening pin, screw, or the like (not shown) securely fastens the rear mounting flange 252 to the end plate 20, but with sufficient play as to permit the above described vertical adjustment of the laser aiming device with respect to the weapon.

Referring to FIG. 15, a U-shaped mounting bracket 262 is secured to the bar 160 by the screws 264. The threaded shaft 266 passes through an opening 268 through the joining web 269 of the bracket 262. The shaft 266 is held stationary against axial motion by the fixing nut 272 at the one side of the web 269 and by its own knurled, manually rotatable head 274 on the opposite side of the web 269. The threaded shaft 266 enters into and is continuously in the threaded opening 206 in the rear mount dovetail shaped element 196. Rotation of the wheel 274 thus moves the entire rear mount 190 across the bar 160 through the dovetail groove 166 and reorients the side to side aiming angle of the aiming device 10 with respect to the aiming point of the weapon. As the mount 190 shifts, the casing 12 will necessarily slightly swivel with respect to the bottom section 192 of the mount 190. The relative rotatability of the sections of rear mount 190 absorbs this relative rotation. Similarly, with respect to the below described front mount 280, the relative rotatability of its sections permits this swiveling to occur.

Referring to FIG. 18, the front mount 280 includes the bottom section 282. Bottom section 282 includes the body 284 beneath which depends the dovetail shaped male mounting flange 286. Dovetail shaped flange 286 is shaped to matingly fit in and is received in slot 170 in bar 160. Atop the body 284 is the annular, top section support base 288 and the upper conical taper 292 for being received in a cooperatingly shaped opening in the top section of the front mount. Further, the body 284 has a threaded opening 294 for receiving the fastening bolt (not shown) that holds the top and bottom sections of the front mount together.

The top section 300 of the front mount 280 is comprised of the body 302, which has a conically shaped central opening 304 in its bottom for receiving the upwardly projecting conical surface 292 such that the top section 300 nests with the bottom section 282. The annular, bottom rim 306 of the body 302 normally rests on the annular surface 288 of the bottom section 282. The top section 300 has a bolt receiving opening 308 with a larger head receiving opening 309 such that a bolt may be pressed through the opening 308 and tightened into the threaded opening 294 to hold the top 300 and bottom 282 sections together. The bolt (not shown) is tightened so as to hold the sections together, but is loose enough so as to permit the tilting of the laser device when its vertical orientation is adjusted and is loose enough to permit the slight horizontal swiveling that occurs when the horizontal aiming point of the aiming device is adjusted.

At the side of the top section 300 is the mounting flange 310 with the pin receiving opening 312 passing therethrough. The flange 310 is inserted between the flanges 77 on the front plate 60 and a pin, screw or bolt (not shown) passes through the aligned openings 79, 312 to fasten the aiming device casing 12 to the front mount 280.

The aiming device must be triggered to operate. In accordance with a feature of the invention, the device that operates the aiming device, i.e. the operator, is always so positioned that when the trigger 316 of the weapon is operated or pulled by the marksman, that action also moves the operator of the aiming device. In accordance with a further aspect of the invention, the aiming device is activated as the weapon trigger 316 is started on its movement toward firing the weapon, but before the trigger has been pulled sufficiently to fire the weapon. With the trigger of the weapon partially depressed, the laser beam is moved as the weapon is aimed. When the weapon is finally aimed because the laser beam is illuminating the target, the partial operation of the trigger 316 can be completed to fire the weapon. Thus, the operator of the weapon need not make any separate or unusual movements to aim the weapon. The aiming can be done during normal operation of the trigger of the weapon.

Figure 4:
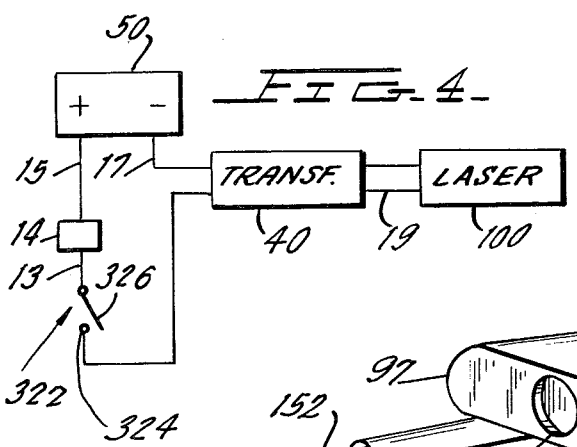
FIG. 4 is a schematic circuit diagram showing the interconnection of the elements of the aiming device according to the invention.

Referring to FIGS. 2, 4 and 20, one embodiment of the laser aiming device operator 320 according to the invention includes a microswitch 322 with a stationary contact 324 extending from the housing of the switch and a movable, weapon trigger operated contact arm 326 also extending from the housing of the switch. The trigger operated contact arm 326 in the illustrated arrangement comprises a curved metal spring. As shown in FIG. 2, the spring 326 is positioned directly behind the trigger 316 and when the trigger is pulled, the spring contact arm 326 is moved against the contact 324 to complete the circuit through the microswitch 322, thereby to activate the laser aiming device. Continued squeezing of the trigger 316 to fire the weapon 180 merely straightens the spring 326 somewhat. When the trigger 316 is released after the weapon has been fired, the spring 326 restores itself to the condition where it is separated from the contact 324.

For holding the microswitch 322 and particularly its contact arm 326 at the desired location behind the trigger 316, the microswitch 322 is secured to the mounting plate 330 which is positioned at one side of the weapon just above the trigger. A bar 332 passes inside and across the trigger guard to the other side of the weapon. The resilient arm 334 is pivotally mounted to the bar 332 at the pivot mount 336 and the arm 334 is movable to a position where it squeezes against the opposite side of the weapon, thereby drawing the plate 330 against the side of the weapon and securely holding the entire operator 320 in place. The microswitch 322 is connected through the cable 13 with the casing 12 and extends to the battery 40, thereby to complete the electrical connection.

Other types of aiming device operators may be used. The only significant feature is that the operator that activates the laser aiming device should be associated with the trigger of the weapon so that as the weapon trigger is partially operated, the aiming device is activated.

Another aiming device operator 340 within the scope of the invention shown in FIG. 21 includes a microswitch 342 located, not near the trigger of the weapon, but at or on or near the casing 12 of the laser aiming device. An element 344 that is operated by the trigger of the weapon, i.e. the functional analog of the arm 326 in FIG. 19, is a depressible plunger 344 positioned directly behind and in the path of movement of the weapon trigger and attached at the end of a mechanical force transmitting cable 346, such as a Bowden cable. When the weapon trigger is operated, the plunger is moved and the force transmitting cable transmits the mechanical force through its plunger 348 to contact the operating arm 30 of switch 350 to close the switch 342 at the casing 12 of the aiming device, which then activates the laser aiming device. Other elements of operator 340 analogous to those of operator 320 are numbered with the same reference numerals and are not further described.

Another alternative would be to have the operating switch which activates the aiming device be connected with a pivotable post depending from the casing 12 and hanging next to the trigger of the weapon. As the weapon trigger is operated, the depending post necessarily is also engaged by the markman's finger and rotated to close the switch that activates the laser aiming device. Other switches and operators for the laser aiming device can be envisioned within the contemplation of the invention.

Although the present invention has been described in connection with a preferred embodiment thereof, many variations and modifications will now become apparent to those skilled in the art. It is preferred, therefore, that the present invention be limited not by the specific disclosure herein, but only by the appended claims.

We claim:

1. A weapon aiming device, comprising:

a light source; means for supplying power to said light source and being connected to said light source; means for directing light emitted by said light source in an aiming direction;

an operator, including a switch, for activating said light source, and being connected to said light source;

an aiming device mount support securable to a weapon;

zeroing means interposed between said mount support and said light source and being adjustable to reorient said light source with respect to the weapon to readjust said light source aiming direction both vertically and horizontally with respect to the aiming direction of the weapon; said zeroing means comprise a front mount located nearer the muzzle of the weapon and a rear mount located further from the muzzle;

said mount support comprises an elongated bar; said bar having a front formation thereon to which said front mount is attached; said bar having a rear formation thereon, spaced from said front formation, to which said rear mount is attached; said bar having opposite front and rear ends near said front and rear mounts, respectively;

both of said mounts being connected to and supporting said light source; one of said mounts being vertically extendable and retractable with respect to said mount support; one of said mounts being laterally movable with respect to said mount support;

the respective said formation for said laterally movable mount comprises a first groove extending laterally across said bar for permitting lateral motion of said laterally movable mount across said bar; said laterally movable mount including first groove engaging means which are in said first groove for guiding lateral motion of said laterally movable mount; laterally movable mount moving means connected between said laterally movable mount and said bar and being adjustable for laterally moving said laterally movable mount with respect to said bar;

the other said formation on said bar comprises a second groove extending from the respective said end of said bar nearer to the other said mount and said second groove extending to the position of the other said mount when it is mounted on said bar; the other said mount including second above engaging means which are received in said second groove, and the engagement between said second groove and said second groove engaging means being shaped and positioned to prohibit lateral motion of the other said mount across said bar.

2. The weapon aiming device of claim 1, wherein said light source is a laser.

3. The weapon aiming device of claim 1, wherein it is the same one of said mounts that is both vertically and laterally movable with respect to said mount support.

4. The weapon aiming device of claim 1, wherein said bar includes weapon engaging means adapted to mate with cooperating means on a weapon, thereby to mount said bar to a weapon.

5. The weapon aiming device of claim 1, wherein said first groove is a dovetail shaped groove and said first groove engaging means comprises a dovetail shaped male element depending beneath said laterally movable mount;

said second groove comprises a dovetail shaped groove and said second groove engaging element comprises a dovetail shaped male element depending beneath the other said mount.

6. The weapon aiming device of claim 1, wherein said laterally movable mount has a threaded opening therein directed laterally across said bar; said laterally movable mount moving means comprises a screw threaded shaft matingly received in said threaded opening in said laterally movable mount;

shaft support means attached to said bar for holding said shaft to permit rotation thereof, while holding said shaft against lateral motion across said bar, whereby rotation of said shaft in said threaded opening shifts said laterally movable mount laterally across said bar.

7. The weapon aiming device of claim 1, further comprising a shaft directed laterally across said bar and also engaging said laterally movable mount; shaft supporting means attached to said bar; said shaft being movable with respect to said shaft supporting means to move said laterally movable mount laterally across said bar.

8. The weapon aiming device of claim 1, wherein said laterally movable mount is said rear mount.

9. A weapon aiming device, comprising:

a light source; means for supplying power to said light source and being connected to said light source; means for directing light emitted by said light source in an aiming direction;

an operator, including a switch, for activating said light source, and being connected to said light source;

an aiming device mount support securable to a weapon;

zeroing means interposed between said mount support and said light source and being adjustable to reorient said light source with respect to the weapon to readjust said light source aiming direction both vertically and horizontally with respect to the aiming direction of the weapon; said zeroing means comprise a mount support and a front mount located nearer the muzzle of the weapon and a rear mount located further from the muzzle; both of said mounts being connected to said mount support and being connected to and supporting said light source; one of said mounts being vertically extendable and retractable with respect to said mount support; one of said mounts being laterally movable with respect to said mount support;

said mount support comprises an elongated bar; said bar having a front formation thereon which said front mount is attachable; said bar having a rear formation thereon, spaced from said front formation, to which said rear mount is attachable;

for said laterally movable mount, the respective said formation on said bar is adapted to permit lateral motion of said laterally movable mount across said bar; laterally movable mount moving means connected between said laterally movable mount and said bar and being adjustable for laterally moving said laterally movable mount with respect to said bar;

said laterally movable mount being comprised of three vertically stacked sections, including a bottom section which is attachable to said mount support, an intermediate section, and a top section atop said intermediate section and attached to said intermediate section in a manner that permits relative rotation of said intermediate section with respect to said top section, said top section being connectable to said light source for supporting it;

the other said mount being comprised of two vertically stacked sections, including a second bottom section attachable to said mount support and a second top section connectable to said light source for supporting it and also attached to said second bottom section in a manner that permits relative motion of said second top and said second bottom sections;

said second bottom section having a top which is shaped to have a conical taper, and said second top section having a bottom with a cooperatingly shaped conically tapered opening formed therein; said conical taper being inserted into said conically tapered opening, thereby enabling relative motion between said second bottom and said second top sections of the other said mount.

10. A weapon aiming device, comprising:

a laser light source; said laser light source includes a laser tube; means for supplying power to said laser light source and being connected to said laser light source; means for directing light emitted by said laser light source in an aiming direction;

an operator, including a switch, for activating said light source, and being connected to said light source;

said means for supplying power to said light source comprising a battery and a transformer connected to said battery for transforming the voltage of said battery to a voltage usable by said light source; said light source being connected to said transformer;

a casing; said casing comprising a hollow tube having a rear end and having a front end; said light source and said means for supplying power to said light source both being located inside and being supported within said casing;

laser tube support means located in said tube casing for supporting said laser tube at a constant orientation with respect to said casing, thereby giving said laser tube a constant said aiming direction with respect to said casing;

said laser tube having a light outlet aimed at said aiming direction; said means for directing light comprising said casing having a light outlet aligned with said laser tube light outlet; a spring located in said casing for normally biasing said laser tube to bias said laser tube light outlet toward said casing light outlet;

said transformer and said battery being aligned inside said casing, and said laser tube being positioned next to and being oriented to extend parallel to the aligned said transformer and said battery;

a rear plate sealingly secured over said tube rear end and a front plate sealingly secured over said tube front end; front and rear plate joining means for drawing said plates together, thereby to hold said transformer and said battery and said laser tube in position in said casing; p1 an aiming device mount support securable to a weapon;

zeroing means interposed between said mount support and said casing and being adjustable to reorient said casing and said light source therein with respect to the weapon to readjust said light source aiming direction with respect to the aiming direction of the weapon.

11. The weapon aiming device of claim 10, wherein said switch of said operator is connected so that when said switch is closed, it activates said light source by completing an electric circuit including said means for supplying power to said light source and including said light source.

12. The weapon aiming device of claim 10, further comprising a partition in said casing between said transformer and said battery; means, including said front and rear plate joining means, for urging said transformer and said battery against said partition; electric contact means on said partition for contacting said battery and said transformer and for electrically connecting them.

13. In combination, a weapon aiming device and a weapon to be aimed by said aiming device;

said weapon being of the type to fire a projectile and said weapon including a trigger which is movable in one direction to operate said weapon to fire a projectile; said aiming device being secured to said weapon by said aiming device mount support;

said aiming device comprising:

a light source, means for supplying power to said light source and being connected to said light source; means for directing light emitted by said light source in an aiming direction;

said aiming device being securable to a weapon;

an operator, including a switch, for activating said light source, and being connected to said light source; said operator comprising a movable means adapted to be placed at the trigger of the weapon to be aimed and said movable means being movable during operation of the weapon trigger to operate said switch to activate said light source;

force transmitting means between said movable means and said switch for transmitting motion of said movable means to said switch;

said movable means of said operator being so positioned as to be engaged by said weapon trigger as said trigger is moved in said one direction, thereby to move said movable means to cause said operator to activate said light source and the placement of said movable means causes said movable means to be operated to fire said weapon.

14. The combination of claim 13, wherein said light source is a laser.

15. The combination of claim 13, wherein said trigger of said weapon must be moved a first distance in said one direction to fire said weapon; said movable means being so designed and placed that motion of said trigger in said one direction a distance less than said first distance causes said movable means to activate said light source.

16. The combination of claim 15, wherein said force transmitting means comprises a force transmitting cable means.

17. A weapon aiming device, comprising:

a light source; means for supplying power to said light source and being connected to said light source; means for directing light emitted by said light source in an aiming direction;

an operator, including a switch, for activating said light source, and being connected to said light source;

an aiming device mount support securable to a weapon;

zeroing means interposed between said mount support and said light source and being adjustable to reorient said light source with respect to the weapon to readjust said light source aiming direction both vertically and horizontally with respect to the aiming direction of the weapon; said zeroing means comprise a mount support and a front mount located nearer the muzzle of the weapon and a rear mount located further from the muzzle; both of said mounts being connected to said mount support and being connected to and supporting said light source; one of said mounts being vertically extendable and retractable with respect to said mount support; one of said mounts being laterally movable with respect to said mount support;

said mount support comprises an elongated bar; said bar having a front formation thereon to which said front mount is attachable; said bar having a rear formation thereon, spaced from said front formation, to which said rear mount is attachable;

for said laterally movable mount, the respective said formation on said bar is adapted to permit lateral motion of said laterally movable mount across said bar; laterally movable mount moving means connected between said laterally movable mount and said bar and being adjustable for laterally moving said laterally movable mount with respect to said bar;

said laterally movable mount being comprised of three vertically stacked sections, including a bottom section which is attachable to said mount support, an intermediate section, and a top section atop said intermediate section and attached to said intermediate section in a manner that permits relative rotation of said intermediate section with respect to said top section, said top section being connectable to said light source for supporting it;

the other said mount being comprised of two vertically stacked sections, including a second bottom section attachable to said mount support and a second top section connectable to said light source for supporting it and also attached to said second bottom section in a manner that permits relative motion of said second top and said second bottom sections;

the respective said formation for said laterally movable mount comprising a first groove extending laterally across said bar and said laterally movable mount including first groove engaging means which are in said first groove for guiding lateral motion of said laterally movable mount;

said bar having opposite front and rear ends near said front and rear mounts, respectively; the other said formation on said bar comprises a second groove extending from the respective said end of said bar nearer to the other said mount and said second groove extending to the position of the other said mount when it is mounted on said bar; the other said mount including second groove engaging means which are received in said second groove, and the engagement between the other said second groove and said second groove engaging means being shaped and positioned to prohibit lateral motion of the other said mount across said bar.

18. The weapon aiming device of claim 17, wherein said first groove comprises a dovetail shaped groove and said first groove engaging means comprises a dovetail shaped male element depending beneath said laterally movable mount;

said second groove comprises a dovetail shaped groove and said second groove engaging element comprises a dovetail shaped male element depending beneath the other said mount.

19. An aiming device, comprising:

a light source; means for supplying power to said light source and being connected to said light source; means for directing light emitted by said light source in an aiming direction;

an operator, including a switch, for activating said light source, and being connected to said light source;

an aiming device mount support securable to an object to be aimed;

zeroing means interposed between said mount support and said light source and being adjustable to reorient said light source with respect to the object to readjust said light source aiming direction both vertically and horizontally with respect to the aiming direction of the object; said zeroing means comprise a front mount located nearer one end of the object and a rear mount located further from the one end;

said mount support comprises an elongated bar; said bar having a front formation thereon to which said front mount is attached; said bar having a rear formation thereon, spaced from said front formation, to which said rear mount is attached; said bar having opposite front and rear ends near said front and rear mounts, respectively;

both of said mounts being connected to and supporting said light source; one of said mounts being vertically extendable and retractable with respect to said mount support; one of said mounts being laterally movable with respect to said mount support;

the respective said formation for said laterally movable mount comprises a first groove extending laterally across said bar for permitting lateral motion of said laterally movable mount across said bar; said laterally movable mount including first groove engaging means which are in said first groove for guiding lateral motion of said laterally movable mount; laterally movable mount moving means connected between said laterally movable mount and said bar and being adjustable for laterally moving said laterally movable mount with respect to said bar;

the other said formation on said bar comprises a second groove extending from the respective said end of said bar nearer to the other said mount and said second groove extending to the position of the other said mount when it is mounted on said bar; the other said mount including second groove engaging means which are received in said second groove, and the engagement between said second groove and said second groove engaging means being shaped and positioned to prohibit lateral motion of the other said mount across said bar.

20. An aiming device, comprising:

a light source; means for supplying power to said light source and being connected to said light source; means for directing light emitted by said light source in an aiming direction;

an operator, including a switch, for activating said light source, and being connected to said light source;

an aiming device mount support securable to an object to be aimed;

zeroing means interposed between said mount support and said light source and being adjustable to reorient said light source with respect to the object to readjust said light source aiming direction both vertically and horizontally with respect to the aiming direction of the object; said zeroing means comprise a mount support and a front mount located nearer one end of the object and a rear mount located further from the one end; both of said mounts being connected to said mount support and being connected to and supporting said light source; one of said mounts being verticaly extendable and retractable with respect to said mount support; one of said mounts being laterally movable with respect to said mount support;

said mount support comprises an elongated bar; said bar having a front formation thereon to which said front mount is attachable; said bar having a rear formation thereon, spaced from said front formation, to which said rear mount is attachable;

for said laterally movable mount, the respective said formation on said bar is adapted to permit lateral motion of said laterally movable mount across said bar; laterally movable mount moving means connected between said laterally movable mount and said bar and being adjustable for laterally moving said laterally movable mount with respect to said bar;

said laterally movable mount is comprised of three vertically stacked sections, including the bottom one of said two sections which is attachable to said mount support, the top of one of said two sections which is an intermediate section, and a top section atop said intermediate section and attached to said intermediate section in a manner that permits relative rotation of said intermediate section with respect to said top section; said top section being connectable to said light source for supporting it;

said intermediate section having a top which is shaped to have a first conical taper, and said top section having a bottom with a cooperatingly shaped first conically tapered opening formed therein; said first conical taper being inserted into said first conically tapered opening, thereby enabling relative motion between said intermediate and said top sections of said laterally movable mount;

said vertically extendable and retractable mount being comprised of two vertically stacked sections, including a second bottom section attachable to said mount support and a second top section connectable to said light source for supporting it and also attached to said second bottom section in a manner that permits relative motion of said second top and said second bottom sections;

said second bottom section having a top which is shaped to have a second conical taper, and said second top section having a bottom with a cooperatingly shaped second conically tapered opening formed therein; said second conical taper being inserted into said second conically tapered opening, thereby enabling relative motion between said second bottom and said second top sections of said vertically extendable and retractable mount.

* * * * *